US006053726A

United States Patent [19]

Kanno

[11] Patent Number: 6,053,726

[45] **Date of Patent: *Apr. 25, 2000**

[54] CAP FIXING STRUCTURE

[75] Inventor: Minoru Kanno, Shizuoka-ken, Japan

[73] Assignee: Tokai Corporation, Shizuoka-Ken, Japan

[ * ] Notice: This patent issued on a continued prosecution application filed under 37 CFR 1.53(d), and is subject to the twenty year patent term provisions of 35 U.S.C. 154(a)(2).

[21] Appl. No.: 09/091,614

[22] PCT Filed: Dec. 12, 1996

[86] PCT No.: PCT/JP96/03623

§ 371 Date: Jun. 18, 1998

§ 102(e) Date: Jun. 18, 1998

[87] PCT Pub. No.: WO97/23755

PCT Pub. Date: Jul. 3, 1997

[30] Foreign Application Priority Data

Dec. 21, 1995 [JP] Japan ..... 7-355040

[51] Int. Cl.[7] ..... F23Q 2/50

[52] U.S. Cl. ..... 431/144; 403/14; 403/329

[58] Field of Search ..... 431/144, 310, 431/153, 277; 29/453; 403/329, 326, 13, 14

[56] References Cited

U.S. PATENT DOCUMENTS 4,071,939 2/1978 Bock ..... 29/453
5,242,297 9/1993 Cirami ..... 431/153
5,346,392 9/1994 Kim ..... 431/277
5,788,476 8/1998 Sher ..... 431/255

FOREIGN PATENT DOCUMENTS 2-90436 7/1990 Japan .
6-30663 4/1994 Japan .

OTHER PUBLICATIONS

PCT/JP96/03623 International Preliminary Examination Report, Mar. 6, 1998.

Bralla, James G., editor, Design for Manufacturability Handbook, 2nd edition, © 1999, pp. 7.12–7.13, McGraw–Hill, New York.

English abstract for Japanese patent application publication 2–90436.

English abstract for Japanese patent application publication 6–30663.

*Primary Examiner*—Ira S. Lazarus
*Assistant Examiner*—Sara Clarke
*Attorney, Agent, or Firm*—BakerBotts, LLP

[57] ABSTRACT

This invention provides a gas lighter (1) in which a cap (7) can be surely and easily mounted on the lighter body. A chamfer (17) having an inclined surface is formed on one side of a recess (15) on a support post (16) of the lighter body. A trapezoidal resilient tongue (11) projecting inward of the cap (7) is formed at the hook portion (6) of the cap (7). The resilient tongue (11) slides on the inclined surface of the chamfer (17) into the recess (15), whereby the hook portion (6) is brought into engagement with the recess (15).

2 Claims, 3 Drawing Sheets

CAP FIXING STRUCTURE

FIELD OF THE INVENTION

This invention relates to a structure for fixing a cap on a lighter body in a gas lighter for lighting cigarettes and the like, and more particularly to such a structure which facilitates bringing the cap into engagement with a recess in a support post formed on the lighter body in automated assembly of the gas lighter.

BACKGROUND

A cap of a gas lighter contributes to mixing fuel gas discharged from a nozzle projecting into the cap with air in a proper ratio so that the air/fuel mixture is ignited by a spark generated by a flint and a file or a piezoelectric element, and keeps the flame burning. The cap is fixed on the lighter body by engagement of hook portions formed on the cap with recesses on support posts formed on the top of the lighter body.

That is, the recess in each support post has an inner wall portion which is perpendicular to the surface of the support post and the hook portion on the cap is formed by projecting inward a part of the cap which is of the same size as the recess or slightly larger than the same. When the cap is mounted on the support posts, the cap is thrust against the lighter body from above to bring the hook portions on the cap into engagement with the recesses on the support posts when the lighter conveyed along an assembly line comes to a position where the hook portions are aligned with the recesses.

However when the cap is thrust against the lighter body before the hook portions are brought into alignment with the recesses, the cap is mounted the lighter body with the hook portions riding on the edges of the recesses. In this state, since the hook portions are not fully engaged with the recesses, the cap can be easily disengaged from the lighter body. Accordingly, when the cap is mounted on the lighter body, the hook portions on the cap must be accurately located with respect to the recesses on the lighter body, which makes difficult assembly of the lighter.

Further when producing the cap and the support post, fluctuation in size and position of the hook portions and/or the recesses is unavoidable, which makes it difficult for adjustment in an automated system and results in an increase in percentage of rejects.

In view of the foregoing observations and description, the primary object of the present invention is to provide a gas lighter in which a chamfer is formed on the peripheral edge of the recess so that the hook portion can be surely brought into engagement with the recess, thereby preventing the cap from slipping off the lighter body.

DISCLOSURE OF THE INVENTION

In order to accomplish the above object, the structure of the present invention comprises a support post formed on the top of the lighter body, a recess formed on the support post, and a cap which has a flame outlet port and is provided with a hook portion adapted to be engaged with the recess and is characterized in that a chamfer is formed on at least one side of the edge of the recess.

When a chamfer is formed on at least one side of the edge of the recess on the support post on the top of the lighter body, the end of a resilient tongue which forms the hook portion is brought into abutment against the inclined surface of the chamfer upon mounting the cap on the lighter body and is guided into the recess, which facilitates assembly of the lighter.

Further fluctuation in size and position of the hook portions and/or the recesses generating in production of these elements is accommodated by the chamfer, thereby facilitating adjustment in an automated system.

BEST MODE OF EMBODYING THE INVENTION

Figure 1:
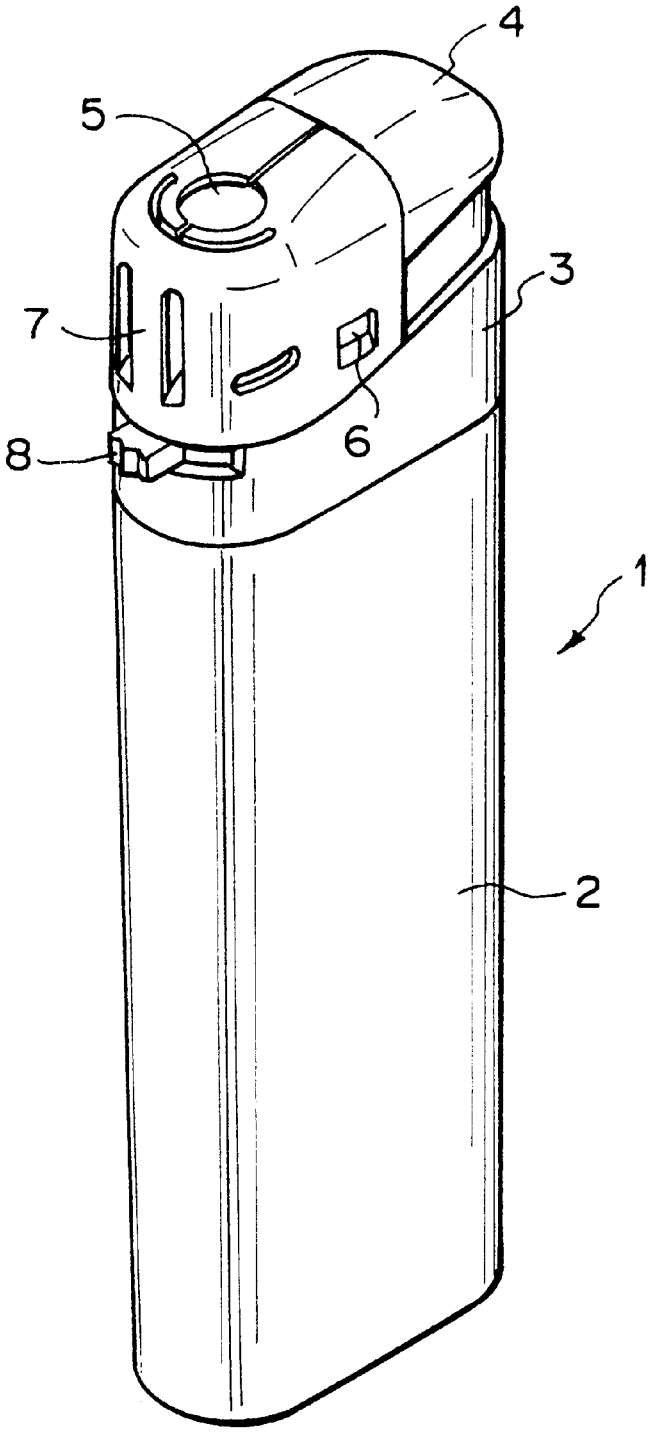
FIG. 1 is a perspective general view of a gas lighter provided with a cap fixing structure in accordance with the present invention.

Cap fixing structures in accordance with embodiments of the present invention will be described with reference to the drawings, hereinbelow. FIG. 1 shows a gas lighter 1 provided with a cap fixing structure of the present invention. The gas lighter 1 comprises a gas reservoir body 2 which is in the form of a bottomed rectangular body of plastic and contains therein liquefied gas, a middle casing portion 3 which closes the open end of the gas reservoir body 2 and on which a gas flow rate regulator mechanism (not shown) is mounted and a pair of support posts for supporting an ignitor 4 such as a piezoelectric element or a file wheel are formed, and a cap 7 which is provided with a flame outlet port 5 and a pair of hook portions 6 formed thereon. Reference numeral 8 denotes a knob for regulating the flame length.

Figure 2:
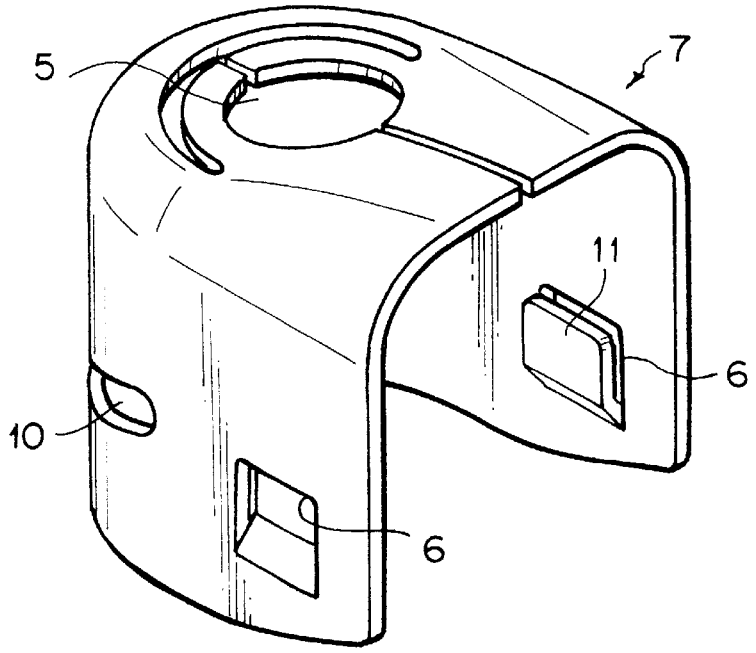
FIG. 2 is a perspective view of the cap.

As shown in FIG. 2, the cap 7 is a horseshoe-like member formed of metal and is provided with the flame outlet port 5 at the top thereof and with a plurality of air holes 10 in the side wall thereof. The hook portion 6 is formed by a resilient tongue 11 which is formed by cutting the cap 7 in a channel shape equal to or slightly smaller in width than a recess 15 to be described later and projecting the cut portion inward in a trapezoidal shape.

Figure 3:
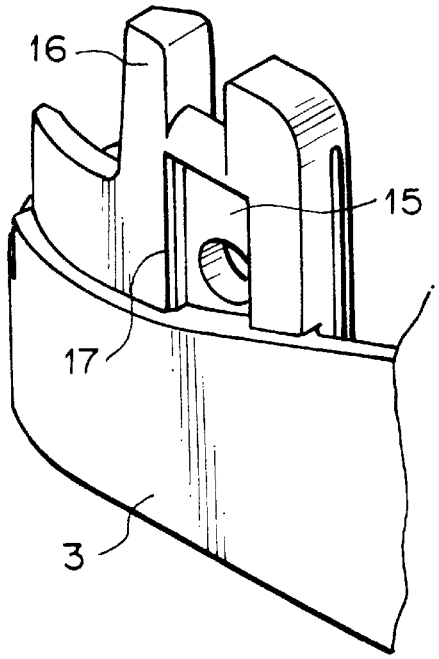
FIG. 3 is a perspective view of the middle casing portion showing a recess in a first embodiment of the present invention.

The recess 15 with which the resilient tongue 11 of the hook portion 6 is brought into engagement is formed on a support post 16 provided on the top of the middle casing portion 3 as shown in FIG. 3. The recess 15 is formed in a square shape in a predetermined depth on a lower portion of the outer surface of the support post 16. One of the sides of the edge of the recess 15 is formed with a chamfer 17 whereas the other sides are perpendicular. That is, said one side is perpendicular from the bottom of the recess 15 substantially up to a middle portion in the direction of depth and then is inclined outward.

The effect of the cap fixing structure with this arrangement will be described in detail with reference to FIGS. 4.

A semi-finished lighter conveyed along an assembly line with the support posts 16 on the middle casing portion 3 directed upward is stopped in a predetermined position relative to a cap mounting machine and the cap 7 is mounted on the semi-finished lighter from above so that the hook portions 6 on the cap 7 are brought into engagement with the recesses 15. When the cap 7 is incorporated with the semi-finished lighter held in a position where the side edges of the resilient tongues 11 are inside the side edges of the corresponding recesses 15, the resilient tongues 11 can be smoothly brought into engagement with the recesses 15.

Figure 4A:
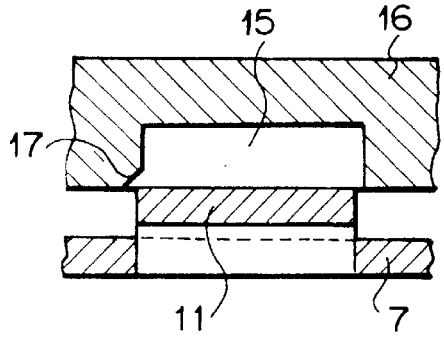
FIGS. 4A and 4B are horizontal cross-sectional views showing the engagement of a resilient tongue forming a hook portion on the cap and the recess.
Figure 4B:
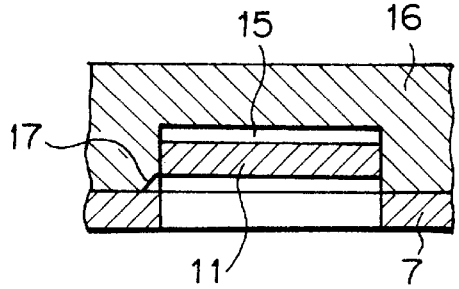

However when the semi-finished lighter is stopped in a position where one side edges of the resilient tongues 11 are shifted outward from the corresponding side edges of the corresponding recesses 15 as shown in FIG. 4A, the side edge of each tongue 11 is brought into abutment against the chamfer 17, and when the cap 7 is further pushed toward the semi-finished lighter, the side edge of the tongue 11 slides on the inclined surface into the recess 15, whereby the resilient tongues 11 are brought into engagement with the recesses 15 as shown in FIG. 4B. Even when the surface of the resilient tongue 11 is brought into abutment against the chamfer 17, the tongue 11 slides on the chamfer 17 into the recess 15.

Figure 5:
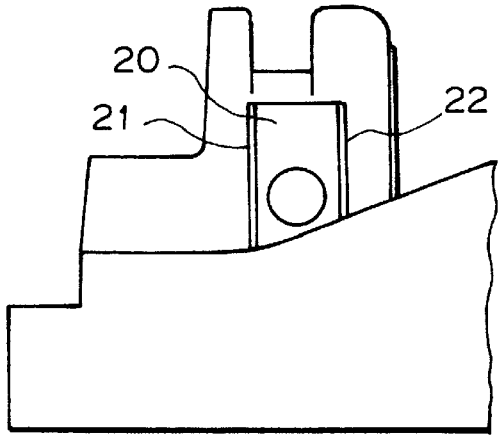
FIG. 5 is a front view showing a recess in a second embodiment of the present invention.
Figure 6:
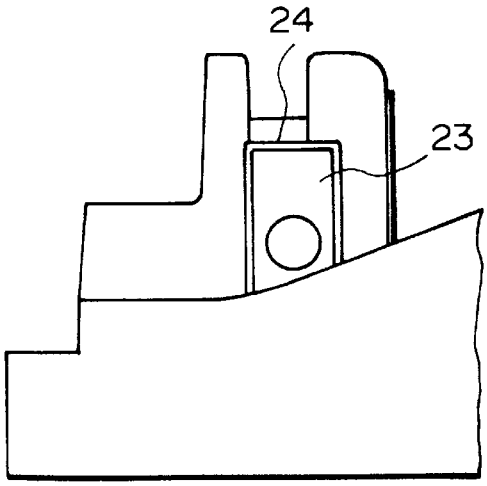
FIG. 6 is a front view showing a recess in a third embodiment of the present invention.

FIG. 5 shows a recess 20 in accordance with a second embodiment of the present invention where the recess 20 is provided with chamfers 21 and 22 on the both sides thereof. FIG. 6 shows a recess 23 in accordance with a third embodiment of the present invention where the recess 23 is provided with a chamfer 24 on the upper side thereof in addition to the both sides. Thus the hook portions of the cap can be surely brought into engagement with the recesses.

I claim:

1. A cap fixing structure comprising a support post formed on a top of a lighter body, a recess formed on the support post, and a cap which has a flame outlet port and is provided with a hook portion having a tongue adapted to be engaged with the recess to prevent the cap from slipping off the lighter body wherein the improvement comprises that a chamfer is formed on at least one side edge of the recess to be engaged by the tongue which slides on the chamfer to guide the hook portion into the recess.

2. A cap fixing structure as defined in claim 1 in which the hook portion is formed by a resilient tongue which is formed by cutting a cap and projecting the cut portion inward in a trapezoidal shape.

* * * * *